United States Patent [19]

Smyth

[11] Patent Number: 4,471,503

[45] Date of Patent: Sep. 18, 1984

[54] BRUSH

[76] Inventor: Donald N. Smyth, 5 Taylor Ct., South Plympton, Australia, 5038

[21] Appl. No.: 417,845

[22] Filed: Sep. 14, 1982

[30] Foreign Application Priority Data

Sep. 14, 1981 [AU] Australia ..... PF0742

[51] Int. Cl.[3] ..... A46B 13/06

[52] U.S. Cl. ..... 15/22 R; 15/29; 128/47

[58] Field of Search ..... 15/22 R, 22 A, 22 C, 15/29, 97 R; 128/47, 50, 53, 60, 62 R; 51/170 R, 170 MT

[56] References Cited

U.S. PATENT DOCUMENTS

| | | | |
|---|---|---|---|
| 1,948,167 | 2/1934 | Cornwell | 15/22 A |
| 3,283,352 | 11/1966 | Hu | 15/22 R |
| 4,374,444 | 2/1983 | Zhadanov | 15/29 |

*Primary Examiner*—Edward L. Roberts

*Attorney, Agent, or Firm*—Oldham, Oldham, Hudak, Weber & Sand Co.

[57] ABSTRACT

A brush for cleaning and washing surfaces with a scrubbing action, the brush having bristles mounted on a body. The body houses a freely rotatable turbine wheel driven by a jet of water. The turbine wheel is eccentrically weighted so that as it rotates it imparts to the body of the brush and the bristles in a vibrating motion.

5 Claims, 3 Drawing Figures

BRUSH

This invention relates to brushes, more particularly to brushes in which a movement is imparted to the brush or bristles or the like to assist in its washing or scrubbing action.

BACKGROUND OF THE INVENTION

Brushes are known which are adapted to be rotated by a jet of water, the brush being mounted in a body attached to a handle, there being a hose or the like adapted to be connected to a source of water so that the jet of water rotates the brush. These forms of brushes are used for washing automobiles, walls, windows and the like, but one of the problems with this form of brush is that in order to achieve sufficient torque on the rotating brush a relatively high flow of relatively high pressure water is required. Also these brushes have a further disadvantage in that when manual pressure is applied to the brush in order to increase the scrubbing or washing action, that there is not sufficient torque to continue rotation of the brush and the brush will slow down and stop.

It is an object of this invention to provide an improved brush in which the bristles are moved relatively to the surface being cleaned.

BRIEF STATEMENT OF THE INVENTION

Thus there is provided according to the invention a brush, the brush having a body, bristles on the brush attached to the body, the body carrying a freely rotatable impeller, an eccentric weight on the impeller, and means for directing a flow of fluid onto the impeller so that on rotation the brush body and bristles vibrate due to the eccentric mass on the impeller.

Figure 3:
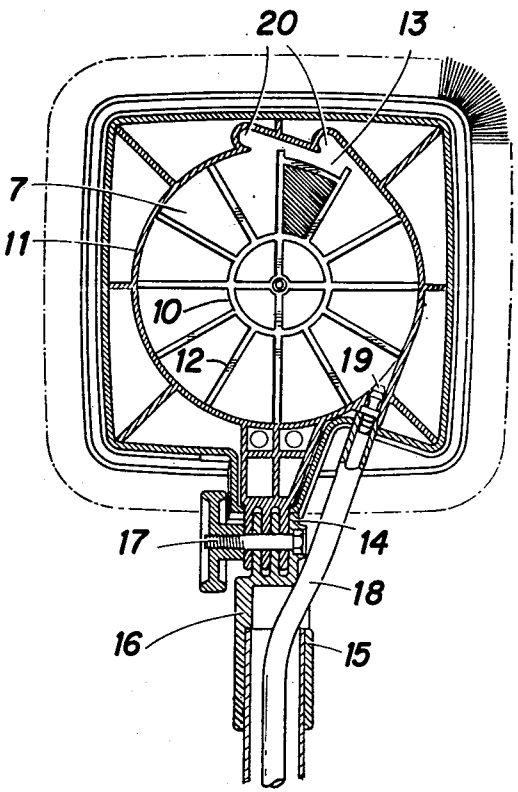
FIG. 3 is a cross-section on the lines 3—3 of FIG. 2.
Figure 2:
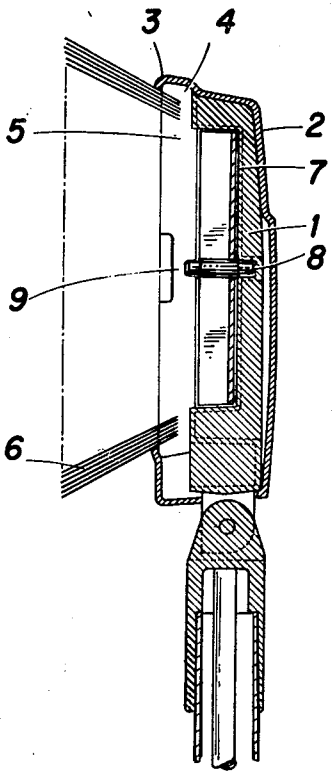
FIG. 2 is a cross-section on the lines 2—2 of FIG. 1.
Figure 1:
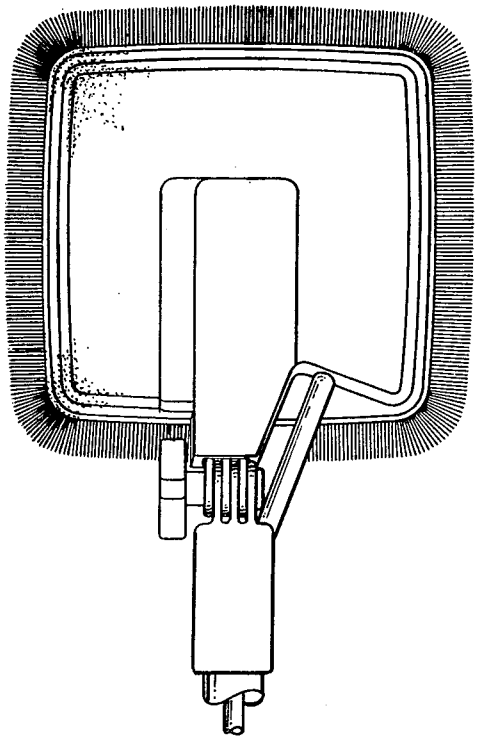
FIG. 1 is a plan view of the brush.

As shown in the drawings the brush body is a generally square cup shaped body, having a housing 2 which is formed at 3 to have a recess 4 to receive a brush board 5 carrying bristles 6.

The brush body 1 is formed with a circular recess 7 formed by wall 11 behind the brush board, an impeller 10 being journalled in a bearing 8 in the brush body and bearing 9 in the brush board 5.

The impeller 10 has a number of blades 2, cups or the like, and is provided with an eccentric weight or mass 13, this preferably being provided between two of the impeller blades 2.

The brush body is provided with a portion 14 to which can be pivoted a handle 15, the handle having a handle connector 16 connected to the body by a locking knob or pin 17 so that the angular relationship of the handle 15 and body 1 can be varied and locked in position.

The handle itself is hollow and carries a tube or hose 18 or the like, this being connected at its brush end to a nozzle 19 in the brush body, the nozzle being adapted to direct the jet of water into the impeller blades 12.

The wall 11 of the recess 7 for the impeller 10 can be provided with exhaust ports or passages 20 or the like for the escape of the water, this water being then allowed to escape through the bristles of the brush.

It has been found that very little water is required to freely spin the impeller and cause the brush body to vibrate due to the impeller carrying the eccentric weight, and this vibration will continue irrespective of the degree of pressure which is applied to the brush to force the bristles into contact with the surface being cleaned.

As the impeller is freely spinning and is not connected to the brushes or bristles in any way then a minimum amount of water is required to spin the impeller.

The brush can be utilised for various purposes both for cleaning automobiles, walls, windows, and also can have industrial application in cleaning equipment, tanks, vats, vessels and the like.

Also in the domestic scene the brush could be utilised for personal use in the bathroom where the vibratory effect would not only have a cleaning but also a therapeutic and stimulating effect on the skin.

Although one form of the invention has been described in some detail it is to be realised that the invention is not to be limited thereto but can include various modifications falling within the spirit and scope of the invention.

I claim:

1. A fluid powered brush, comprising a brush body, a recess in said body, an unbalanced freely rotatable impeller rotatably mounted in said recess, a brush board carrying bristles attached to said brush body and closing said recess, said brush board defining a plane and the bristles extend outwardly of the brush board from said plane, said impeller also defining a plane which is parallel to said plane of said brush board and being journaled between said brush body and said brush board, means in said brush body for directing a flow of fluid onto said impeller so that on rotation of the impeller the brush body and brush board vibrate due to the rotation of the unbalanced impeller, and means in said recess forming an exhaust for said fluid.

2. A brush as defined in claim 1, further characterized in that said impeller comprises a series of vanes and an eccentric mass positioned between a pair of said vanes.

3. A brush as defined in claim 2 further characterized by bearing means in said body and brush board to carry said freely rotatable impeller.

4. A brush as defined in claim 1 further characterized in that said body further includes a nozzle to direct a flow of water onto said impeller to rotate same, said nozzle being connected to a hose associated with said handle.

5. A brush as defined in claim 1 further characterized in that the fluid exhausts through the bristles of the brush.

* * * * *